US007380835B2

(12) United States Patent
McCoy et al.

(10) Patent No.: US 7,380,835 B2
(45) Date of Patent: Jun. 3, 2008

(54) SINGLE BORE HIGH FLOW JUNCTION PLATE

(75) Inventors: Richard McCoy, Cypress, TX (US); Michael Cunningham, Richards, TX (US); C. Curtis Waters, Houston, TX (US)

(73) Assignee: Oceaneering International, Inc., Houston, TX (US)

( * ) Notice: Subject to any disclaimer, the term of this patent is extended or adjusted under 35 U.S.C. 154(b) by 378 days.

(21) Appl. No.: 11/262,229

(22) Filed: Oct. 28, 2005

(65) Prior Publication Data

US 2008/0007064 A1 Jan. 10, 2008

Related U.S. Application Data

(60) Provisional application No. 60/622,768, filed on Oct. 28, 2004.

(51) Int. Cl.
*E21B 7/12* (2006.01)
*E21B 41/04* (2006.01)

(52) U.S. Cl. ..... 285/24; 285/18; 285/27; 166/338; 166/341; 166/347

(58) Field of Classification Search ..... 285/18, 285/24, 26, 27, 29; 166/338, 341, 347
See application file for complete search history.

(56) References Cited

U.S. PATENT DOCUMENTS

| | | | | |
|---|---|---|---|---|
| 4,943,187 | A * | 7/1990 | Hopper | 405/190 |
| 5,024,467 | A * | 6/1991 | Truchet | 285/365 |
| 5,265,980 | A * | 11/1993 | Lugo et al. | 405/169 |
| 5,333,691 | A * | 8/1994 | Dean et al. | 166/341 |
| 5,417,459 | A * | 5/1995 | Gray et al. | 285/26 |
| 5,794,701 | A * | 8/1998 | Cunningham et al. | 166/341 |
| 6,053,252 | A * | 4/2000 | Edwards | 166/348 |

FOREIGN PATENT DOCUMENTS

GB 2196081 A * 4/1988

* cited by examiner

*Primary Examiner*—James M Hewitt
(74) *Attorney, Agent, or Firm*—Duane Morris LLP

(57) ABSTRACT

Described herein a single bore, high flow junction plate and flow line assembly adapted for use subsea. This junction plate may be adapted for use with a torque tool manipulated by a remotely operated vehicle ("ROV").

20 Claims, 10 Drawing Sheets

SINGLE BORE HIGH FLOW JUNCTION PLATE

PRIORITY INFORMATION

This application claims the benefit of U.S. Provisional Application No. 60/622,768, filed on Oct. 28, 2004.

FIELD OF THE INVENTION

The invention relates to junction plates. The invention more specifically relates to a single bore, high flow junction plate and flow line assembly adapted for use subsea. This invention may be adapted for use with a torque tool manipulated by a remotely operated vehicle ("ROV").

BACKGROUND OF THE INVENTION

Junction plates are used subsea. The flow path through current junction plates is typically not straight and makes turns though perimeter port holes or flow paths. The stabs cannot typically be equipped with multiple seals that can be engaged on an as-needed basis, and the junction plates rely on multiple, small-bore hydraulic couplers that are ganged together to create a sufficiently large flow path. The use of such hydraulic couplers increases the cost of such junction plates.

BRIEF DESCRIPTION OF THE DRAWINGS

The features, aspects, and advantages of the present invention will become more fully apparent to persons skilled in the art from the following description, appended claims, and accompanying drawings in which:

DETAILED DESCRIPTION OF AN EXEMPLARY EMBODIMENT

It is generally believed that gas injection into oil flow lines will become a more common practice. The disclosed inventions allow the connection of a gas source to the oil flow line to achieve that. An advantage is that the design of the disclosed inventions affords a large unobstructed flow path in a design that uses a very simple latching mechanism. Additionally, a preferred embodiment of the present invention utilizes a J-slot "lock". Further, "replacement" seals can be "installed" simply by rotating the lead screw by a controlled amount.

Figure 1:
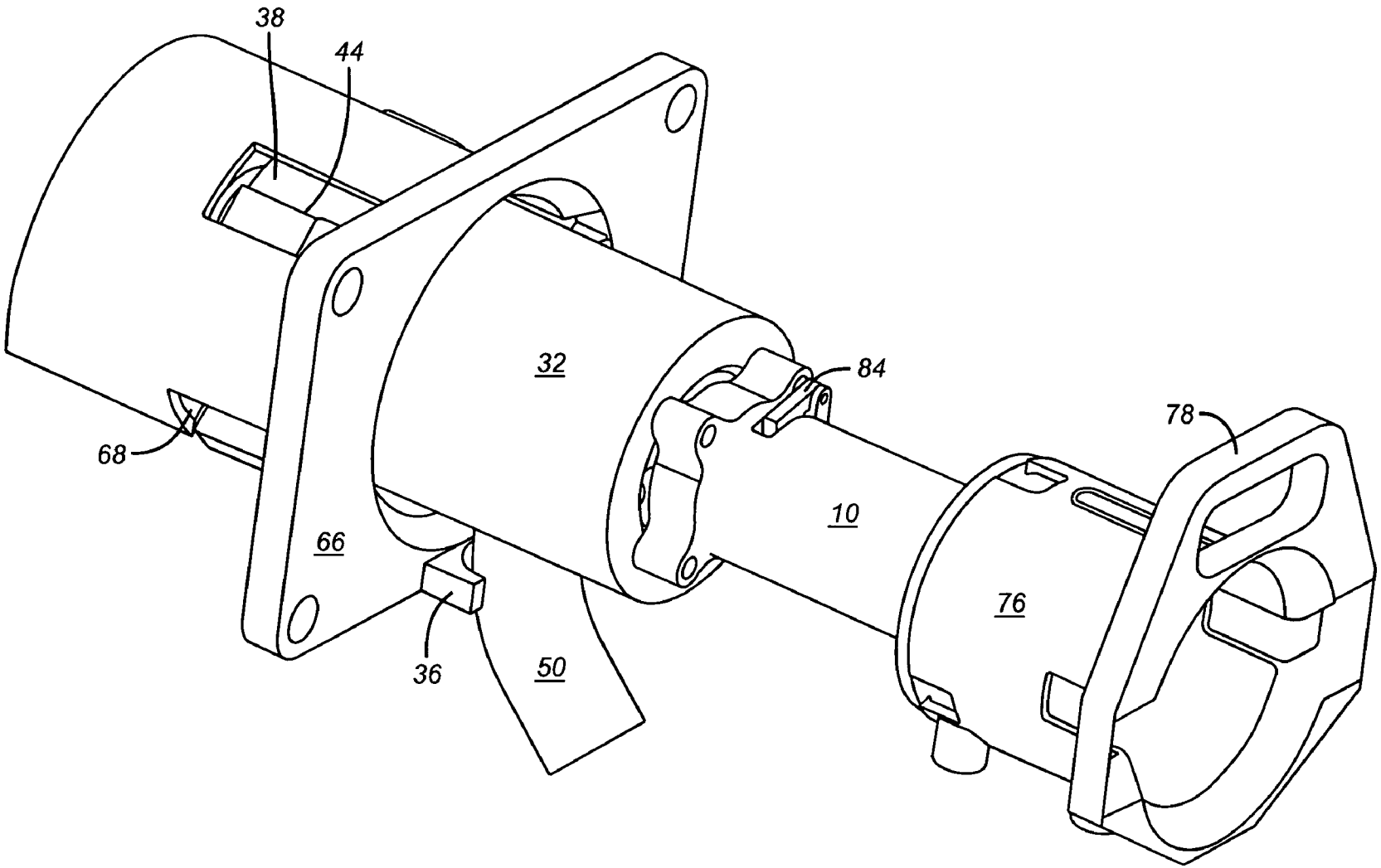
FIG. 1 is an isometric view of the present invention wherein the antirotation lugs are seated in the J slots.
Figure 2:
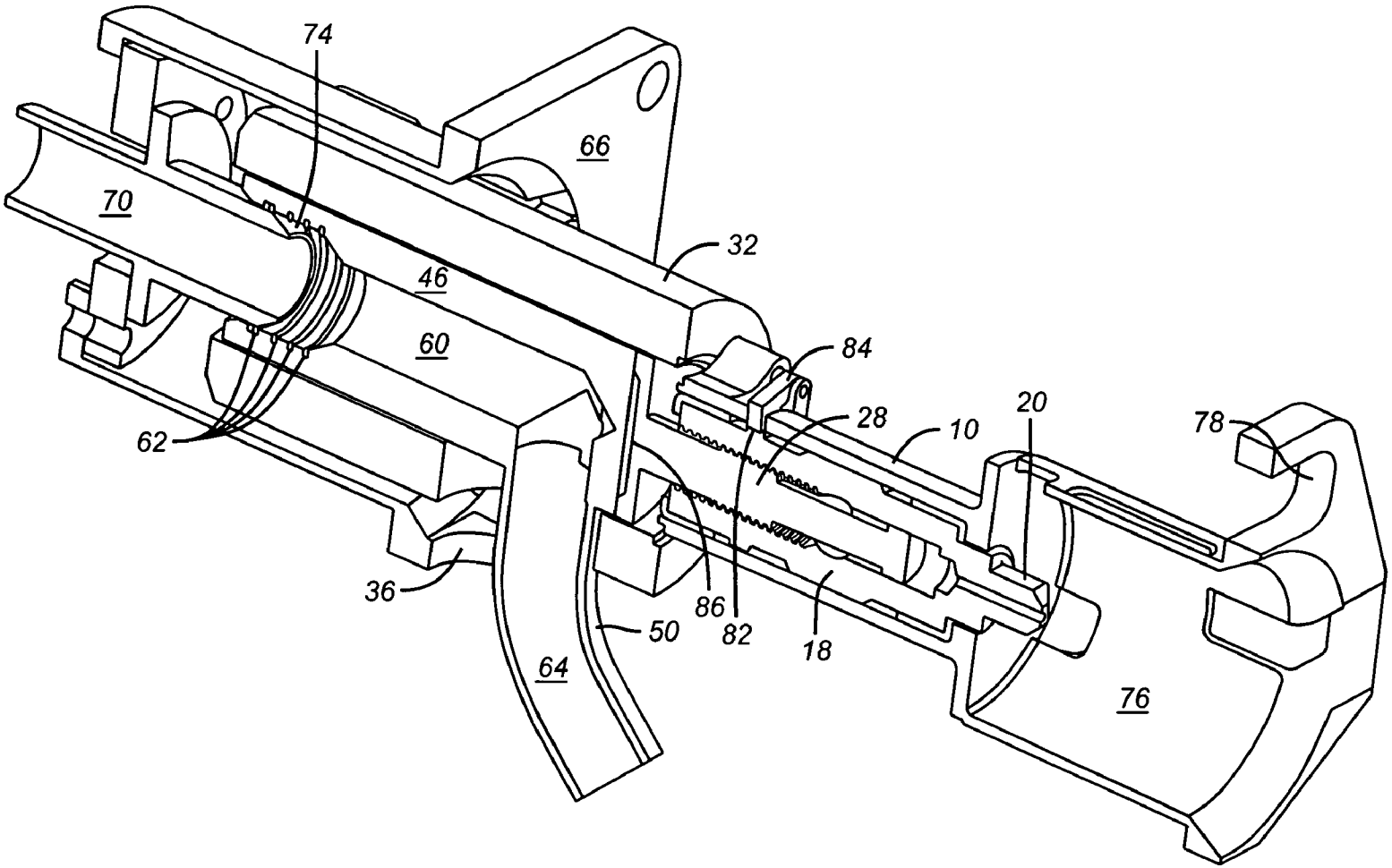
FIG. 2 is an isometric cutaway view of the present invention in the nonengaged configuration.
Figure 3:
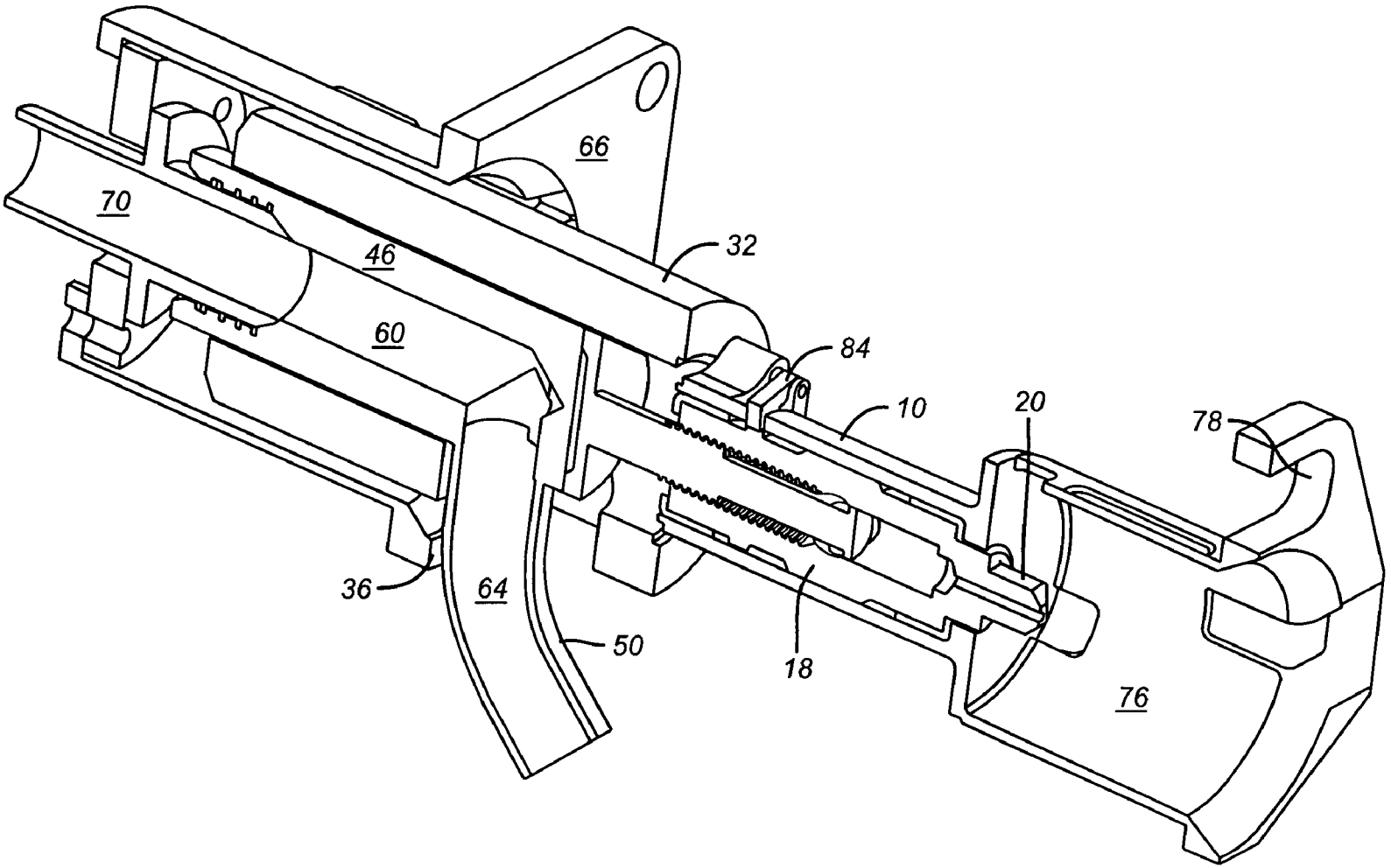
FIG. 3 is an isometric cutaway view of the present invention in the engaged configuration.

Referring generally to the preferred embodiments depicted in FIGS. 1-3, a single port stab is an assembly that is connected to one end of a high flow line, typically a gas-injection line. In a preferred embodiment, an ROV engages the torque bucket using an ROV torque tool and the ROV "flies" the stab to the stab receptacle which is permanently mounted at the subsea gas injection point. The ROV rotates the torque tool, and consequently the male half of the junction plate, so as to allow alignment and subsequent engagement of the J-slots and their respective lugs. Once the male junction plate half is fully inserted into the female junction plate half, the male half is rotated until the lugs are properly seated in the J-slots.

In a preferred embodiment, a torque tool rotates the stationary lead screw and the female stab advances until one or more seals is engaged on the outer surface of the male stab which is contained within female subsea half of the junction plate. A pressure seal is thereby created. By controlling the linear advance of the female stab containing the seals, one can sequentially install "replacement" seal(s) as required without having to disconnect the stab and retrieve it to the surface.

Simultaneous with the creation of the fluid pressure seal is the engagement of the anti-rotation lug that prevents the junction plate halves from rotating with respect to each other, thus ensuring that the junction plate cannot come apart under pressure.

In one preferred embodiment, an optional spring element at the rear of the moveable portion of the stab creates preload in the event that metallic seals are used instead of elastomeric gland seals.

In a preferred embodiment, to prevent vibration-induced rotation of the lead screw once the stabs are engaged, the ROV can flip a ratchet pawl into position onto a gear cut into the lead screw shaft. This pawl is unidirectional and has the additional benefit of serving as a rotation counter since it will move up and down a finite number of counts (equal to the tooth count) for every complete rotation of the lead screw. This forms a highly accurate turn counter.

Figure 4:
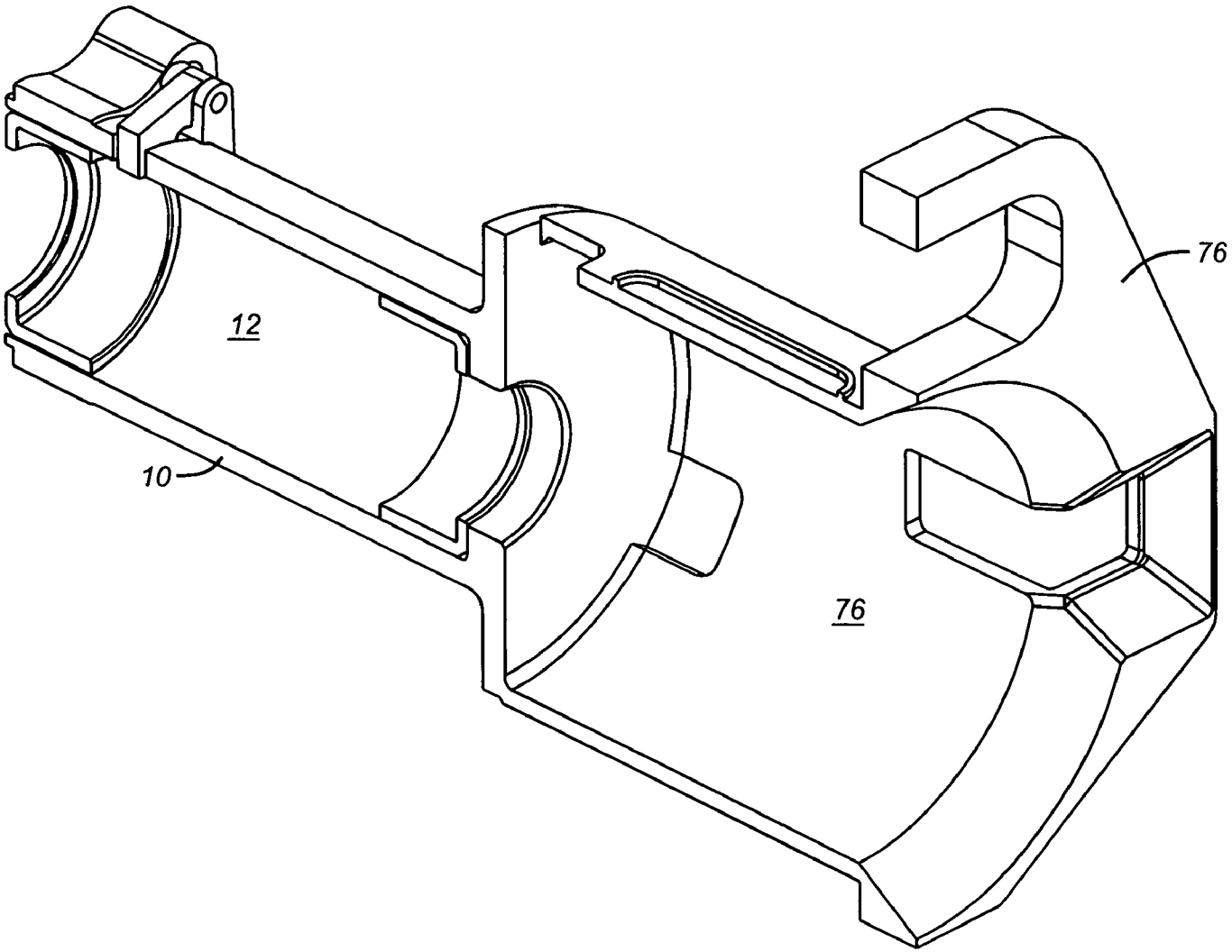
FIG. 4 is an isometric cutaway view of a preferred embodiment of an outer housing and torque bucket assembly suitable for use in practicing the present invention.

Referring now generally to FIGS. 1-10, a junction plate provides a fluid flow path and comprises an outer housing 10 comprising a longitudinal channel 12. A preferred embodiment of the outer housing is shown in FIG. 4

Figure 5:
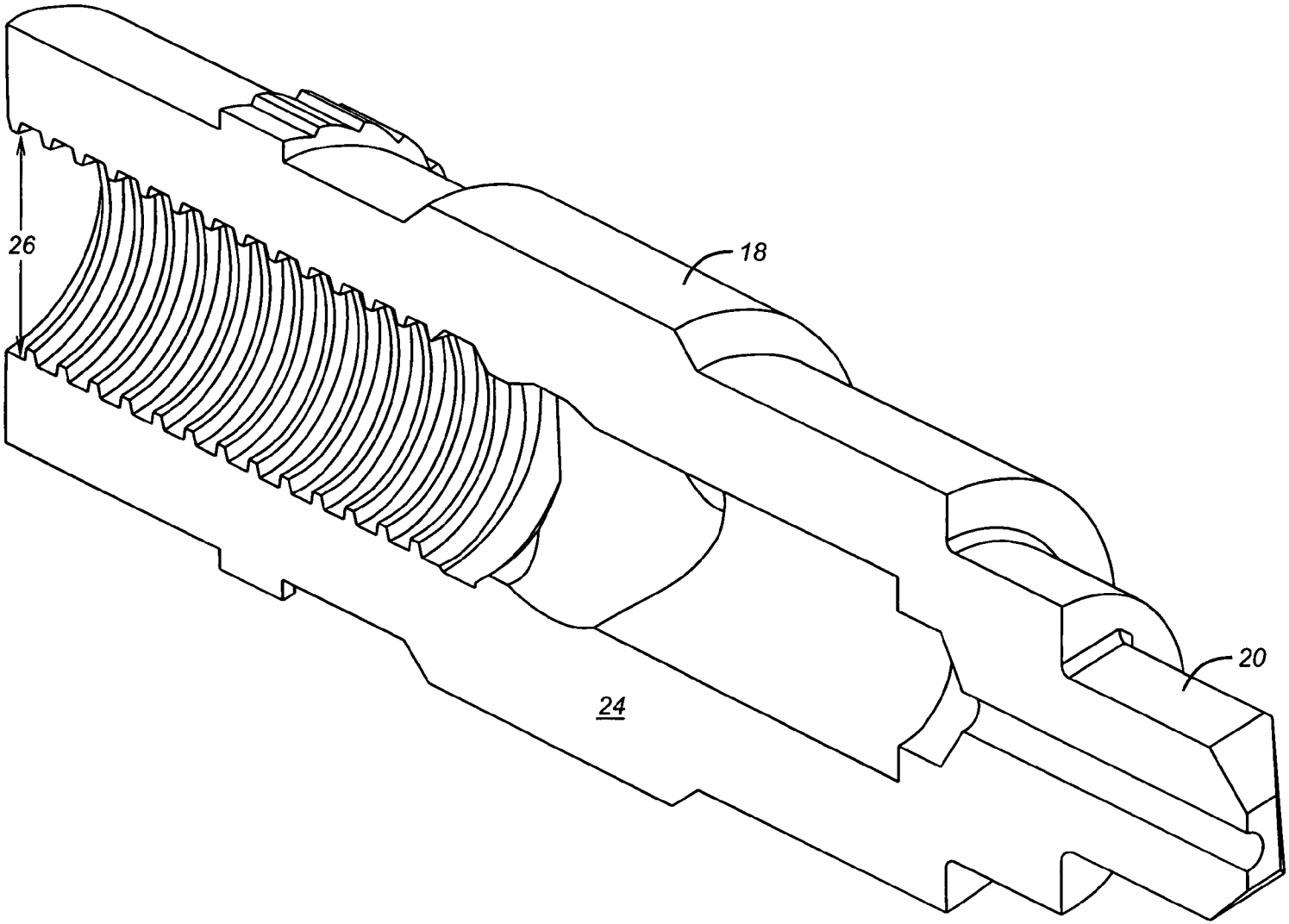
FIG. 5 is an isometric cutaway view of a preferred embodiment of a linearly stationary rotating nut suitable for use in practicing the present invention.

A linearly stationary rotating nut 18 is mounted in the longitudinal channel, as shown in FIGS. 2-3. The nut has a proximal portion 20 adapted to be snugly coupled to a torque tool, and a cylindrical distal portion 24 rotatably mounted in the longitudinal channel. The distal portion comprises a female threaded inner diameter 26. The nut 18 is an internally threaded sleeve. A preferred embodiment of the linearly stationary rotating nut is shown in FIGS. 2-3 and 5.

Figure 6:
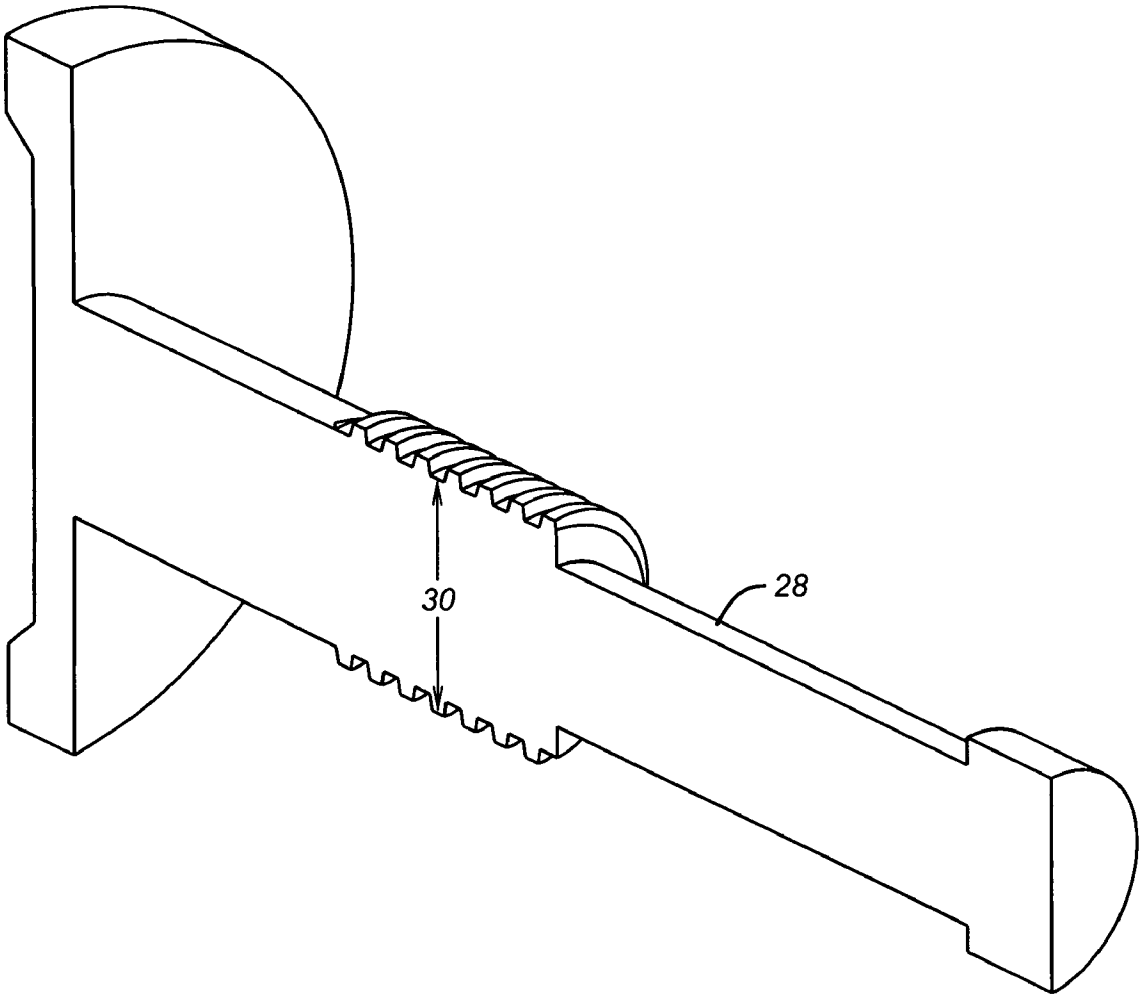
FIG. 6 is an isometric cutaway view of a preferred embodiment of a lead screw suitable for use in practicing the present invention.

The invention further comprises a lead screw 28 comprising a male threaded outer diameter 30 rotatably engaging the female threaded inner diameter such that when the rotating nut is rotated in a first direction, it causes longitudinal movement of the lead screw toward the proximal end region, and when the rotating nut is rotated in a second direction opposite from the first direction, it causes longitudinal movement of the lead screw away from the proximal end region. A preferred embodiment of the lead screw is shown in FIGS. 2-3 and 6.

Figure 7:
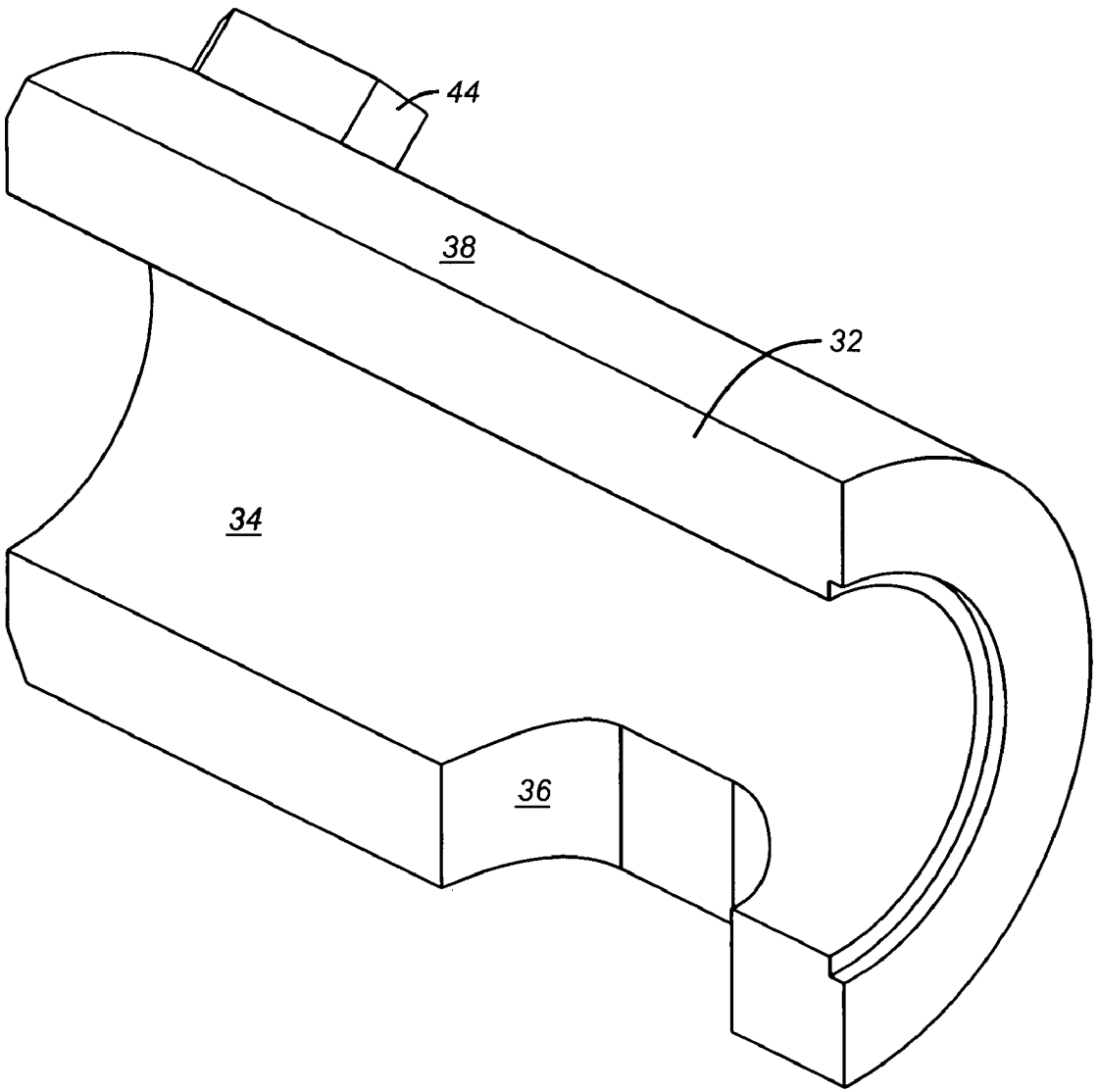
FIG. 7 is an isometric cutaway view of a preferred embodiment of a cylindrical flow path sleeve suitable for use in practicing the present invention.

The invention further comprises a flow path sleeve 32 having an inner surface 34, and an outer surface 38. In a preferred embodiment, the flow path sleeve comprises a flowpath restrainer 36 mounted on the flow path sleeve. The term "flowpath restrainer" has used herein refers to any type of coupling or passage that is capable of restraining rotation of a member extending through the restrainer with respect to the flow path. In a preferred embodiment, the flow path sleeve is cylindrical. The flow path sleeve comprises an inner diameter sized to receive the lead screw. The flow path sleeve further comprises at least one sleeve lug 44 mounted on the outer surface. A preferred embodiment of the cylindrical flow path sleeve is shown in FIGS. 2-3 and 7.

The invention further comprises a slideable flow path 46 comprising an outer wall 48, and a section 50 extending outward from the outer wall. In one preferred embodiment, this section extends into the flowpath restrainer so as to restrict rotation of the slideable flow path relative to the flow path sleeve. The slideable flowpath further comprises a first region comprising a proximal section 52 adjacent to the lead screw, a distal section 54 opposite the proximal section, and an outer diameter sized to slideably fit within the inner diameter of the cylindrical flow path sleeve. The first region further comprising a first flow path 60 in substantial longitudinal alignment with the lead screw, and a first sealing surface 62 extending circumferentially around the distal section. As shown in FIGS. 2-3, the slideable flow path is coupled to the lead screw, which is mounted in the nut, or internally threaded sleeve 18.

Figure 8:
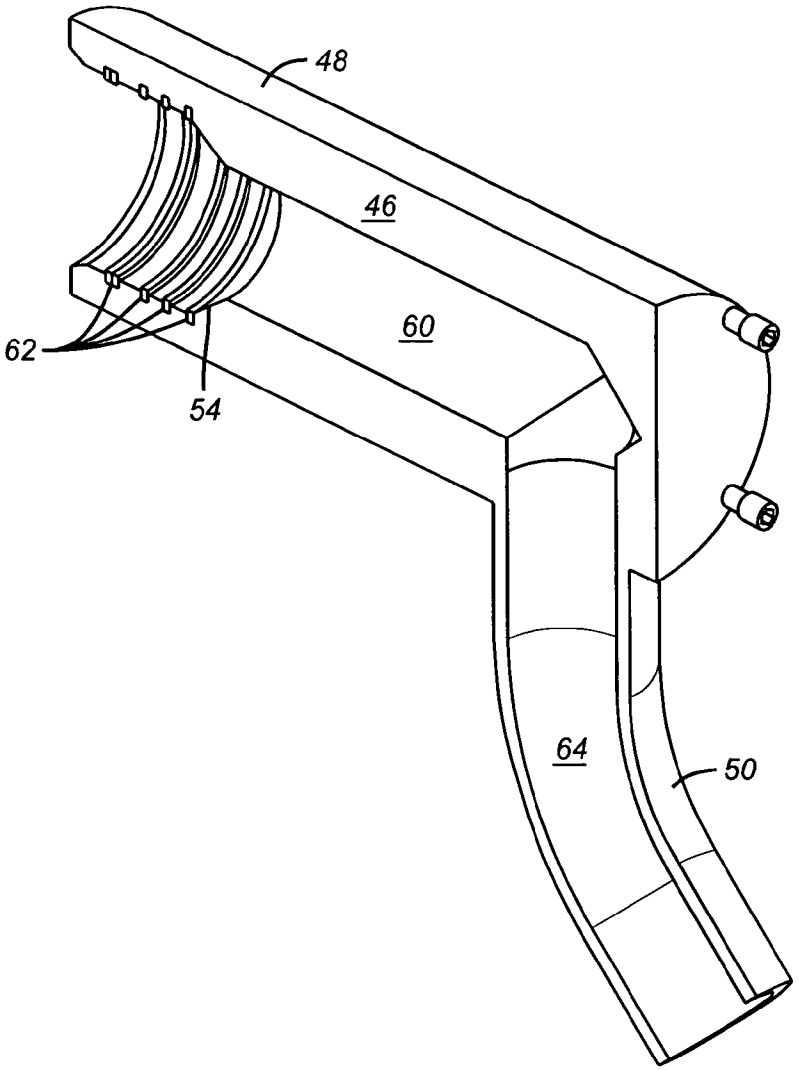
FIG. 8 is an isometric cutaway view of a preferred embodiment of a slideable flow path suitable for use in practicing the present invention.

The section 50 comprises an internal flow path 64 in fluid communication with and not longitudinally aligned with, the first flow path 60. A preferred embodiment of the slideable flow path is shown in FIGS. 2-3 and 8. As shown in FIGS. 2-3, the slideable flow path 46 is partially mounted within the flow path sleeve 32.

Figure 9:
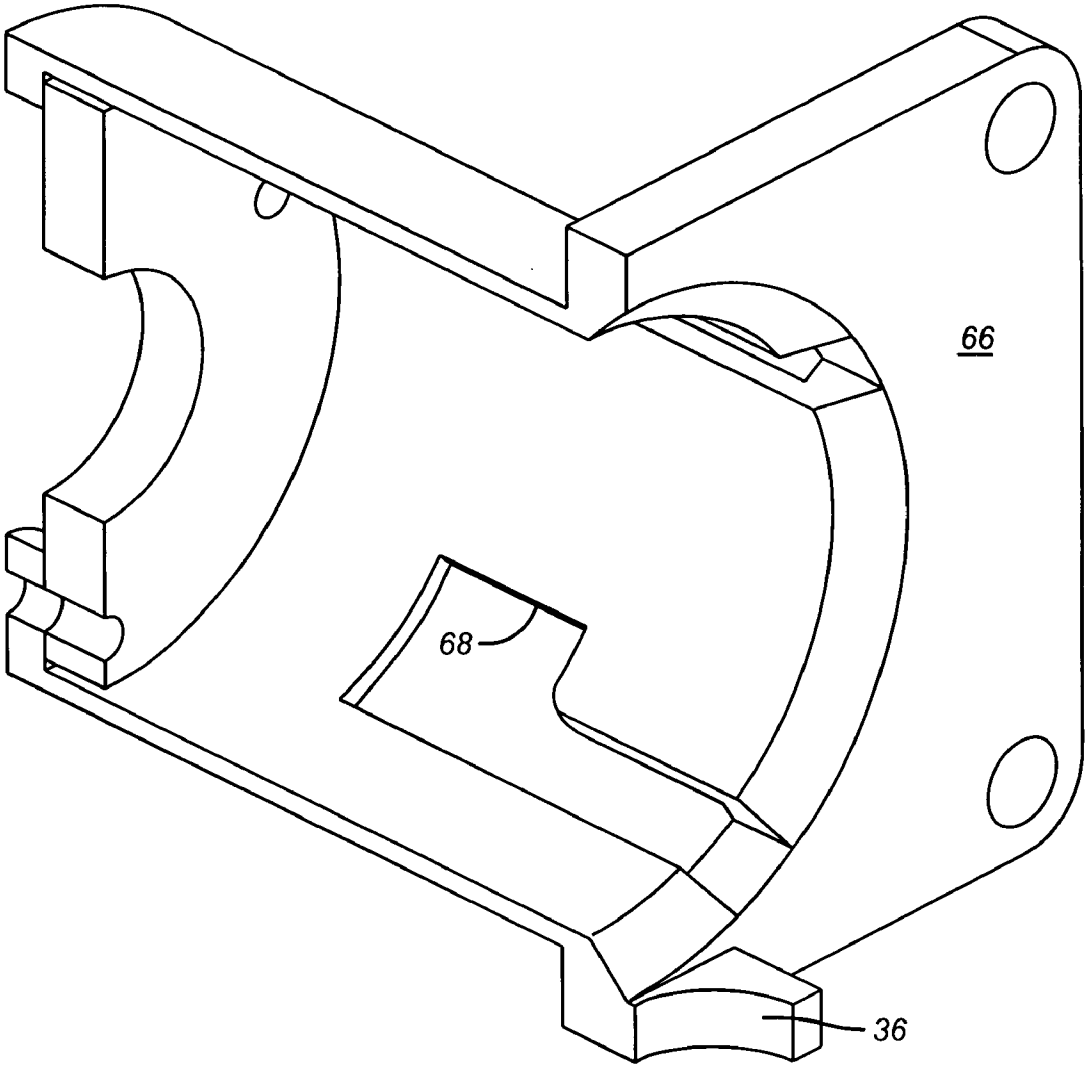
FIG. 9 is an isometric cutaway view of a preferred embodiment of a junction plate suitable for use in practicing the present invention.

The invention further comprises a junction plate 66 comprising a slot 68 adapted to engage the sleeve lug such that the cylindrical flow path can be longitudinally locked into position. As shown in FIGS. 2-3, the junction plate 66 is coupled to the flow path sleeve 32. A preferred embodiment of the junction plate is shown in FIGS. 2-3 and 9.

Figure 10:
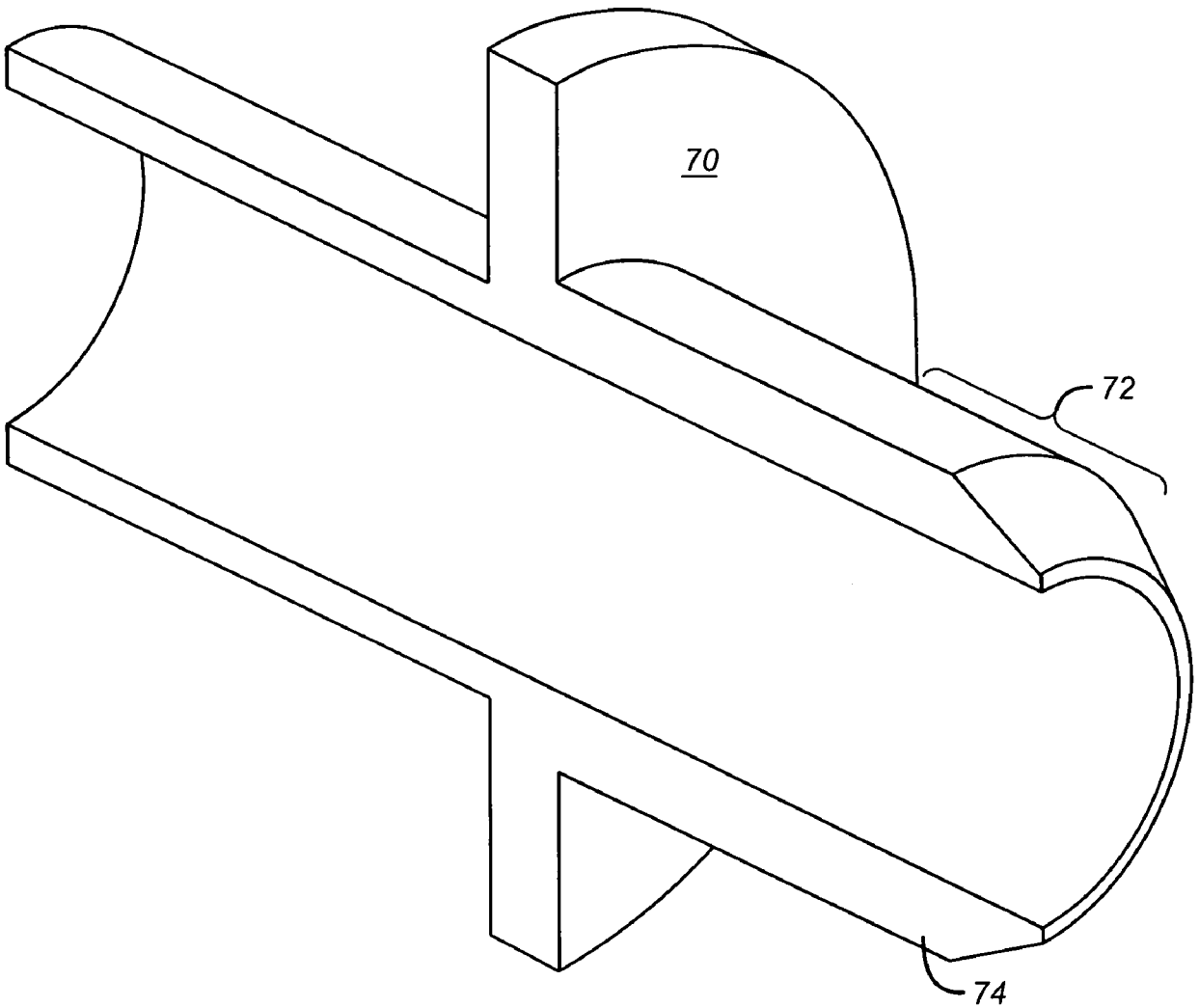
FIG. 10 is an isometric cutaway view of a preferred embodiment of an inner stationary flow path suitable for use in practicing the present invention.

The junction plate further comprises a inner stationary flow path 70 comprising a first end segment 72 mounted to be coupled with the distal section and positioned in longitudinal alignment with the first region of the slideable flow path. The inner stationary flow path is adjacent to the distal section of the slideable flow path. The first end segment comprises a second sealing surface 74 positioned such that when the lead screw is advanced away from the proximal end region, the first and second sealing surfaces come into contact with each other to form a pressure seal between the inner stationary flow path and the distal section of the slideable flow path to impede leakage of any pressurized fluid that may flow through the flow paths. A preferred embodiment of the inner stationary flow path is shown in FIGS. 2-3 10. As shown in FIGS. 2-3, the inner stationary flow path is in substantial longitudinal alignment with the first flow path of the slideable flow path. In one preferred embodiment, the first and second sealing surfaces are metallic. In another preferred embodiment, the first and second sealing surfaces are elastomeric.

The junction plate may further comprise an ROV torque bucket 76 coupled to the rotating nut such that rotation of the torque bucket causes rotation of the rotating nut, the torque bucket comprising a proximate end region 78 adapted to be coupled to a torque tool and a cylindrical distal end region opposite the proximate end region. In a preferred embodiment, the junction plate slot slideably engages the sleeve lug. In a preferred embodiment the junction plate slot may be a J-slot.

In certain preferred embodiments, the junction plate may further comprise a multiplicity of ratchet teeth 82 extending radially outward from the linearly stationary rotating nut; and a pawl 84 hingedly attached to the outer housing to engage at least two of the teeth to prevent rotation of the rotating nut in one of the first or second direction while permitting rotation of the rotating nut in the opposite direction, as shown in FIGS. 2-3.

The junction plate may further comprise a spring 86 inserted between the lead screw and the flow path sleeve, as shown in FIG. 2. The spring may be a belleville washer. In certain embodiments, the distal end of the lead screw is flexible.

It will be understood that various changes in the details, materials, and arrangements of the parts which have been described and illustrated above in order to explain the nature of this invention may be made by those skilled in the art without departing from the principle and scope of the invention as recited in the claims.

What is claimed is:

1. A junction plate and flow line assembly for providing a fluid flow path, comprising:

(a) an outer housing comprising a longitudinal channel, and a distal region;

(b) a linearly stationary rotating nut mounted in the longitudinal channel, said rotating nut comprising a proximal portion adapted to be coupled to a torque tool, and a threaded distal portion rotatably mounted in the distal region of the outer housing;

(c) a lead screw rotatably engaging the threaded distal portion such that when the rotating nut is rotated in a first direction, it causes longitudinal movement of the lead screw toward the proximal portion and when the rotating nut is rotated in a second direction opposite from the first direction, it causes longitudinal movement of the lead screw away from the proximal portion;

(d) a flow path sleeve comprising an outer surface, said flow path sleeve comprising an inner diameter sized to receive the lead screw, said flow path sleeve further comprising at least one sleeve lug mounted on the outer surface;

(e) a slideable flow path comprising an outer wall, a section extending outward from the outer wall, a first region comprising a proximal section adjacent to the lead screw, a distal section opposite the proximal section, and an outer diameter sized to slideably fit within the inner diameter of the cylindrical flow path sleeve, said first region further comprising a first flow path longitudinally aligned with the lead screw, and a first sealing surface mounted in the distal section, said section further comprising an internal flow path in fluid communication with, and not longitudinally aligned with, the first flow path; and (f) a junction plate comprising a slot adapted to engage said sleeve lug such that the flow path sleeve can be longitudinally locked into position, said junction plate further comprising an inner stationary flow path comprising a first end segment mounted to be coupled with the distal region and positioned in substantial longitudinal alignment with the first region of the slideable flow path, said first end segment comprising a second sealing surface positioned such that when the lead screw is advanced toward the inner stationary flow path, the first and second sealing surfaces come into contact with each other to form a pressure seal between the inner stationary flow path and the distal section of the slideable flow path.

2. The junction plate and flow line assembly of claim 1, further comprising a torque bucket coupled to the rotating nut such that rotation of the torque bucket causes rotation of the rotating nut, said torque bucket comprising a proximate end region adapted to be coupled to a torque tool and a distal end region opposite the proximate end region.

3. The junction plate and flow line assembly of claim 1, wherein the first and second sealing surfaces are metallic.

4. The junction plate and flow line assembly of claim 1, wherein the first and second sealing surfaces are elastomeric.

5. The junction plate and flow line assembly of claim 1, wherein the junction plate slot is a J-slot.

6. The junction plate and flow line assembly of claim 1 further comprising:

(a) a multiplicity of ratchet teeth extending radially outward from said linearly stationary rotating nut; and (b) a pawl hingedly attached to said outer housing to engage at least two of said teeth to prevent rotation of said rotating nut in one of the first or second direction while permitting rotation of said rotating nut in the opposite direction.

7. The junction plate and flow line assembly of claim 1, further comprising a spring inserted between the lead screw and the flow path sleeve.

8. The junction plate and flow line assembly of claim 1, wherein the distal portion of the rotating nut is female threaded and the lead screw is male threaded.

9. A junction plate and flow line assembly for providing a fluid flow path, comprising:

(a) an outer housing comprising a longitudinal channel, and a distal region;

(b) a linearly stationary rotating nut mounted in the longitudinal channel, said rotating nut comprising a proximal portion adapted to be coupled to a torque tool, and a threaded distal portion rotatably mounted in the distal region of the outer housing;

(c) a lead screw rotatably engaging the threaded distal portion such that when the rotating nut is rotated in a first direction, it causes longitudinal movement of the lead screw toward the proximal portion and when the rotating nut is rotated in a second direction opposite from the first direction, it causes longitudinal movement of the lead screw away from the proximal portion;

(d) a flow path sleeve comprising an outer surface, an inner diameter sized to receive the lead screw, and at least one sleeve lug mounted on the outer surface;

(e) a slideable flow path comprising an outer wall, a section extending outward from the outer wall, a first region comprising a proximal section adjacent to the lead screw, a distal section opposite the proximal section, and an outer diameter sized to slideably fit within the inner diameter of the flow path sleeve, said first region further comprising a first flow path in substantial longitudinal alignment with the lead screw, and a first sealing surface mounted in the distal section, said section further comprising an internal flow path in fluid communication with, and not longitudinally aligned with, the first flow path; and (f) a junction plate comprising a slot adapted to engage said sleeve lug such that the flow path sleeve can be longitudinally locked into position, said junction plate further comprising an inner stationary flow path comprising a first end segment mounted to be coupled with the distal region and positioned in substantial longitudinal alignment with the first region of the slideable flow path, said first end segment comprising a second sealing surface positioned such that when the lead screw is advanced toward the inner stationary flow path, the first and second sealing surfaces come into contact with each other to form a pressure seal between the inner stationary flow path and the distal section of the slideable flow path.

10. The junction plate and flow line assembly of claim 9, wherein the first sealing surface extends circumferentially around the distal section.

11. The junction plate and flow line assembly of claim 9, further comprising a torque bucket coupled to the rotating nut such that rotation of the torque bucket causes rotation of the rotating nut, said torque bucket comprising a proximate end region adapted to be coupled to a torque tool and a distal end region opposite the proximate end region.

12. The junction plate and flow line assembly of claim 9, wherein the junction plate slot is a J-slot.

13. The junction plate and flow line assembly of claim 9, wherein the flow path sleeve is cylindrical.

14. A junction plate and flow line assembly for providing a fluid flow path, comprising:

(a) an outer housing comprising a longitudinal channel, and a distal region;

(b) a linearly stationary rotating nut mounted in the longitudinal channel, said rotating nut comprising a threaded distal portion rotatably mounted in the distal region of the outer housing and a proximal portion opposite the distal portion;

(c) a lead screw rotatably engaging the threaded distal portion such that when the rotating nut is rotated in a first direction, it causes longitudinal movement of the lead screw toward the proximal portion and when the rotating nut is rotated in a second direction opposite from the first direction, it causes longitudinal movement of the lead screw away from the proximal portion;

(d) a flow path sleeve comprising an outer surface, an inner diameter sized to receive the lead screw, and at least one sleeve lug mounted on the outer surface;

(e) a slideable flow path comprising an outer wall, a section extending outward from the outer wall, a first region comprising a proximate section adjacent to the lead screw, a distal section opposite the proximal section, and an outer diameter sized to slideably fit within the inner diameter of the flow path sleeve, said first region further comprising a first flow path in substantial longitudinal alignment with the lead screw, said section further comprising an internal flow path in fluid communication with, and not longitudinally aligned with, the first flow path; and (f) a junction plate comprising a slot adapted to engage said sleeve lug such that the flow path sleeve can be longitudinally locked into position, said junction plate further comprising an inner stationary flow path comprising a first end segment mounted to be coupled with the distal region and positioned in substantial longitudinal alignment with the first region of the slideable flow path.

15. The junction plate and flow line assembly of claim 14, wherein the junction plate slot is a J-slot.

16. The junction plate and flow line assembly of claim 14, further comprising a torque bucket coupled to the rotating nut such that rotation of the torque bucket causes rotation of the rotating nut, said torque bucket comprising a proximate end region adapted to be coupled to a torque tool and a distal end region opposite the proximate end region.

17. A junction plate assembly for providing a fluid flow path, comprising:

(a) a junction plate comprising an inner stationary flow path;

(b) a flow path sleeve coupled to the junction plate;

(c) a slideable flow path partially mounted within the flow path sleeve, said slideable flow path comprising an outer wall, a section extending outward from the outer wall, a distal section adjacent to the inner stationary flow path, and a proximal section opposite the distal section, a first flow path in substantial longitudinal alignment with the inner stationary flow_path, said section further comprising an internal flow path in fluid communication with, and not longitudinally aligned with, the first flow path; and (d) an internally threaded sleeve comprising a lead screw rotatably mounted in the threaded sleeve such that rotation of the lead screw in a first direction causes it to move longitudinally toward the slideable flow_path, and rotation of the lead screw in a second direction opposite from the first direction, causes it to move longitudinally away from the slideable flow_path, said lead screw being coupled to the slideable flow path.

18. The junction plate and flow line assembly of claim 17, further comprising at least one lug mounted on the outer surface of the flow path sleeve, and wherein the junction plate comprises a slot adapted to engage the lug such that the flow path sleeve can be longitudinally locked into position.

19. The junction plate and flow line assembly of claim 18, wherein the internally threaded sleeve comprises a proximal portion adapted to be coupled to a torque tool.

20. The junction plate and flow line assembly of claim 19, wherein the slot is a J slot.

* * * * *

UNITED STATES PATENT AND TRADEMARK OFFICE

CERTIFICATE OF CORRECTION

PATENT NO. : 7,380,835 B2
APPLICATION NO. : 11/262229
DATED : June 3, 2008
INVENTOR(S) : Richard W. McCoy, Michael Cunningham and C. Curtis Waters It is certified that error appears in the above-identified patent and that said Letters Patent is hereby corrected as shown below:

Column 7, line 15, delete "_".
Column 8, line 2, delete "_".
Column 8, line 5, delete "_".

Signed and Sealed this

Twenty-ninth Day of July, 2008

JON W. DUDAS
*Director of the United States Patent and Trademark Office*